United States Patent [19]

Rex

[11] Patent Number: 5,054,243

[45] Date of Patent: Oct. 8, 1991

[54] BRAKE LINING GRINDER APPARATUS AND METHOD

[75] Inventor: Jay A. Rex, Greenville, Ohio

[73] Assignee: General Motors Corporation, Detroit, Mich.

[21] Appl. No.: 398,843

[22] Filed: Aug. 25, 1989

[51] Int. Cl.[5] ..... B24B 19/28

[52] U.S. Cl. ..... 51/78; 51/281 R; 51/102; 51/116; 51/5 B; 51/327

[58] Field of Search ..... 51/281 R, 215 H, 215 UE, 51/74 R, 82 R, 78, 102, 110, 128, 327, 5 B, 116

[56] References Cited

U.S. PATENT DOCUMENTS

| | | | |
|---|---|---|---|
| 610,201 | 9/1898 | Perry | 51/78 |
| 1,305,916 | 6/1919 | Maier et al. | 51/74 R |
| 1,823,065 | 9/1931 | Scruby | 51/102 |
| 1,830,868 | 11/1931 | Bankhead | 51/102 |
| 1,949,070 | 2/1934 | Barrett | 51/102 |
| 1,961,175 | 6/1934 | Smith | 51/74 R |

FOREIGN PATENT DOCUMENTS

| | | | |
|---|---|---|---|
| 0827013 | 1/1952 | Fed. Rep. of Germany | 51/215 H |

*Primary Examiner*—Robert A. Rose
*Attorney, Agent, or Firm*—Ernest E. Helms

[57] ABSTRACT

A brake lining grinder has feed wheels and an abrasion wheel defining a finishing throat through which one of a plurality of brake lining blanks are feed for simultaneously finishing the arcuate inner surface of the lining to precisely conform to the shape of the arcuate outer surface of a brake drum. The grinder includes an inlet guide surface for stacking a plurality of lining blanks for continuous automatic sequential feed through the finishing throat and the grinder further includes an outlet guide surface for receiving finished blanks for automatic gravity release from the grinder. A method is disclosed for automatically and sequentially finishing a plurality of brake lining blanks having unfinished side surfaces and an unfinished arcuate inner surface by stacking a plurality of the lining blanks on an inlet guide surface for passage across a grinding wheel and simultaneously finishing of the side and inner arcuate surfaces of the blank by the grinding wheel to a finished form conforming to the shape of the exterior outer surface of a brake drum.

13 Claims, 4 Drawing Sheets

BRAKE LINING GRINDER APPARATUS AND METHOD

FIELD OF THE INVENTION

This invention relates to apparatus and methods for finish grinding the surfaces of brake lining blanks and more particularly to such apparatus and methods for automatically finishing brake lining blanks of arcuate form to conform the inner arcuate surface thereon to the arcuate outer surfaces of a brake drum at a mounting interface therebetween.

BACKGROUND OF THE INVENTION

Current brake lining grinder apparatus for finishing arcuately shaped brake linings has separate grinders for finishing side surfaces, an outer arcuate wear surface conformable to a brake drum and an inner arcuate mounting surface adapted to conform to the outer arcuate surface of a brake shoe. The equipment uses the wear surface of the brake lining to establish a reference surface for guiding the brake lining with respect to a grinder for shaping the inside surface thereof to accurately conform to the arcuate shape of a brake shoe to which the brake lining is attached.

Such apparatus requires the outer arcuate surface of the blank to be preformed to have an even smooth surface such that the finished inside radius of the brake lining will accurately conform to the brake shoe.

The problem with such apparatus is that the lining blank must be prefinished before it is directed through the grinder for conforming the lining blank to a shape for mounted on a brake shoe. Additionally, the existing apparatus require separate finishing of the side surfaces of the brake linings. An additional unexpected problem arises if the outer arcuate surface of a brake lining is prefinished. Such prefinishing can obliterate brake part identification markings of the material supplier making it difficult to trace a part back to the raw materials used in the manufacture of an individual part.

SUMMARY OF THE INVENTION

Accordingly an object of the present invention is to eliminate prefinishing steps for producing reference surfaces on a brake lining blank prior to finishing the arcuate inner surface thereon to conform to the shape of a mating brake shoe.

A further object of the present invention is to provide a method for automatically and sequentially finishing a plurality of arcuate brake lining blanks without requiring a prefinishing of the outer wear surface thereof.

A feature of the present invention is to simplify the finishing of an arcuate brake lining blank by a method which combines the finishing of side surfaces and the inner arcuate mounting surface of the blank in a single step without requiring prefinishing of the outer arcuate surface of the brake lining.

Another feature of the invention is to provide such a method including sequentially finishing a plurality of stacked brake lining blanks.

Still another feature of the present invention is to provide apparatus for such simplified one step finishing wherein inlet and discharge tracks are provided with different radii conforming to the radius of the unfinished part and the finished part, respectively, for smoothly guiding an arcuate lining blank into driving relationship with a resilient drive roller for feeding a blank with an inner arcuate surface of unfinished radius through a finishing throat where the unfinished radius is progressively ground to form an inner arcuate surface with a radius which is constant irrespective of variances in the radius of the inner arcuate surface on unfinished blanks and wherein the brake lining blank is withdrawn from the finishing throat by a resilient drive roller that will drive the lining blank onto a discharge having a radius conforming to the finished radius on the lining.

Still another feature of the present invention is to provide the grinder apparatus of the preceding object further characterized by the inlet track having a radius which is larger than the maximum free state radius of the inner arcuate surface of the brake lining blank as it is drawn thereacross by the inlet flexible drive roller.

Yet another feature of the present invention is to provide a grinder wheel in the grinder apparatus which is located on an axis of rotation offset from and between the axes of rotation of said drive rollers to define the finishing throat therebetween and wherein the outside surface of the grinding wheel is located radially inwardly of the throat a distance to cause material to be removed from the unfinished radius of the inner arcuate surface to form an inner arcuate surface having a uniform finished radius end to end of the inner arcuate surface.

Still another feature of the present invention is to provide grinder apparatus as set forth above further characterized by the grinding wheel having a cylindrical central segment and side segments for simultaneously finishing the inside arcuate surface and side surfaces of an unfinished brake lining blank as it is directed through the finishing throat of the machine.

A further object of the present invention is to provide a grinder machine as set-forth above wherein the drive rollers have a width less than the width of the brake lining blank so as to permit simultaneous finishing of the side surface of the brake lining blank.

Yet another object of the present invention is to provide an improved method for finishing the side walls and inner arcuate surface of a brake lining blank by supporting the blank so that the inner arcuate surface thereof will have a maximum actual free state radius equal to the final finished radius plus the amount of material removed therefrom by a rotatable grinding wheel.

A further feature of the method of the preceding paragraph is to provide a brake lining blank of arcuate shape with an unfinished pair of arcuate side walls and an arcuate unfinished inner surface thereon; providing a guide member having diametrically opposite curved guide surfaces thereon with one of the curved guide surfaces having a radius corresponding to the free state radius of the unfinished blank passed thereacross and the other of the curved guide surfaces having a radius corresponding to the finished radius of the blank directed from the rotatable grinding wheel and providing grinder means between the guide surfaces including a generally arcuate finishing throat formed in part by a rotatable cylindrical abrasive surface for removing material from the inner surface of a brake lining blank; supporting a plurality of stacked brake lining blanks on the guide surface; forcing individual ones of the stacked brake lining blanks from the guide surface into the grinder means for feed through the finishing throat; removing a selected thickness of material from the inner arcuate surface of the brake lining in accordance with the grinding radius of the grinder means to produce a finished lining having a precise arcuate shape conforming to the exterior arcuate surface of a brake shoe irrespective of differences in the shape of the inner arcuate surfaces of the brake lining blanks stacked on the inlet guide surface.

Another object of the present invention is to provide the methods of the preceding paragraphs wherein the method also includes simultaneous cutting and finishing of the brake lining blanks for forming a plurality of finished linings from a single brake lining blank.

The foregoing and other objects, features and advantages of the invention will be more apparent from the following description when taken in conjunction with the accompanying drawings in which:

DETAILED DESCRIPTION OF A PREFERRED EMBODIMENT

Figure 1:
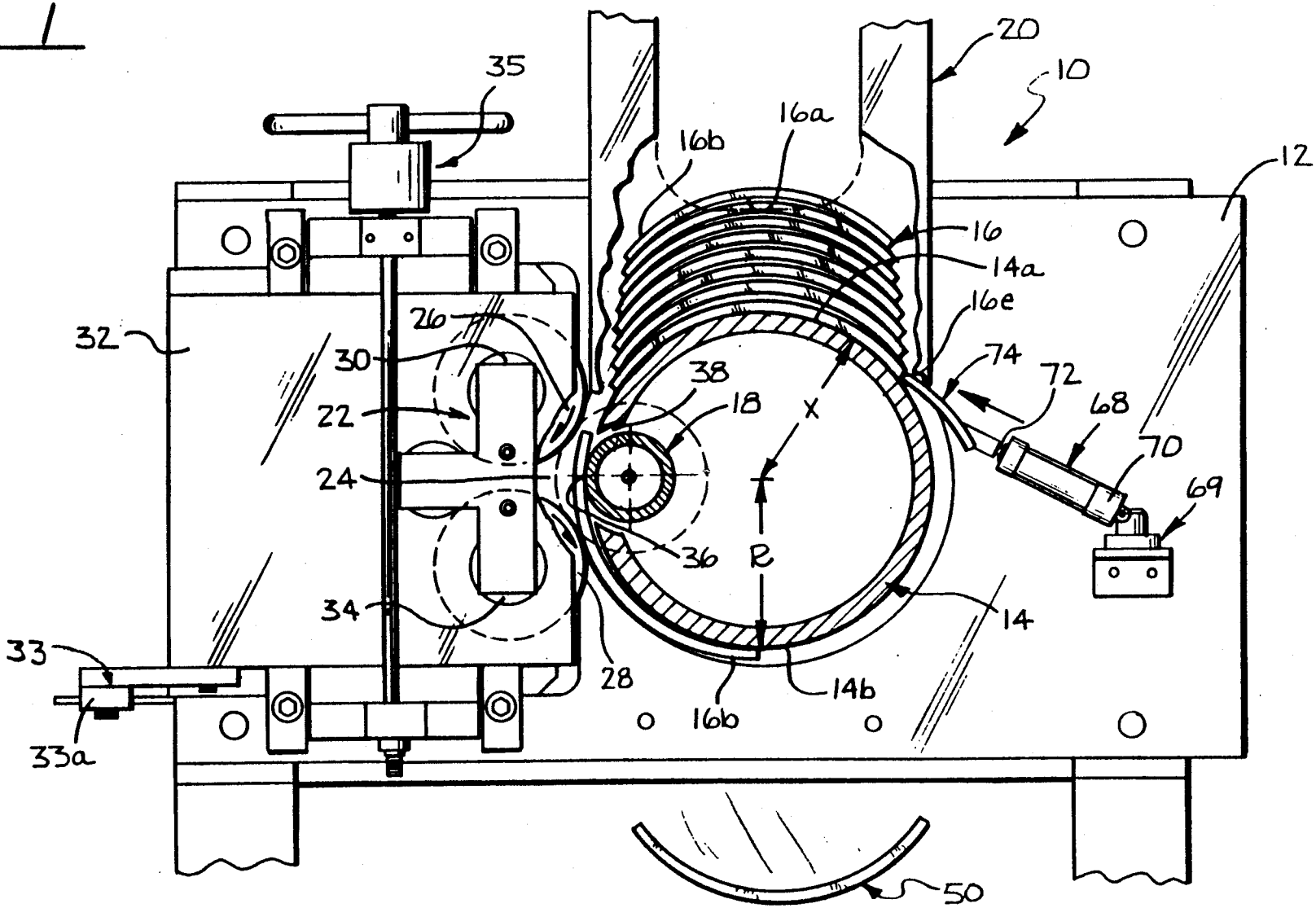
FIG. 1 is a front elevational view, partially broken away and partially sectioned of grinder apparatus including the present invention.

Referring now to FIG. 1, a grinder apparatus for finishing arcuate brake linings is generally identified by reference numeral 10. The grinder apparatus 10 includes a machine base 12 supporting a guide member 14 for automatically and sequentially directing individual ones of a plurality of arcuate brake lining blanks 16 for finishing with respect to a grinding wheel 18.

More specifically, the grinder apparatus 10 includes a feed hopper 20 for receiving a stack of brake lining blanks 16 each having a unfinished arcuate inner surface **16*a* with a radius that may vary from blank to blank. In order to finish the arcuate inner surface 16*a* to a desired finished radius R, the guide member 14 has an infeed track surface 14*a* thereon with a radius X corresponding to the maximum actual free state radius of the unfinished arcuate inner surface. For illustrative purposes finished radius R equals radius X plus the amount of material to be removed from the unfinished arcuate inner surface 16*a* by the grinding wheel 18**.

The grinder apparatus 10 further includes a feeder station 22 for drawing the brake lining blanks 16 from an infeed track **14*a* thence through a finishing throat 24 which is disposed with respect to the grinding wheel 18** for removal of material from the lining blanks without using the outer arcuate surfaces thereof as a reference surface.

The guide member 14 has the infeed track **14*a* and a discharge track 14*b* located diametrically of infeed track 14*a*. Discharge track 14*b* is located downstream of the finishing throat 24. The finishing throat is defined by a pair of resilient drive rollers 26, 28 located at the feeder station 22. The drive roller 26 is supported by a bearing block 30 on a platform 32 mounted for adjustment with respect to the machine base 12 by an adjustment mechanism 33 including an adjustment wheel 33*a* for adjusting the width of finishing throat 24. A clamp assembly 35 is provided to lock the platform 32 in its adjusted position with respect to base 12**.

Figure 2:
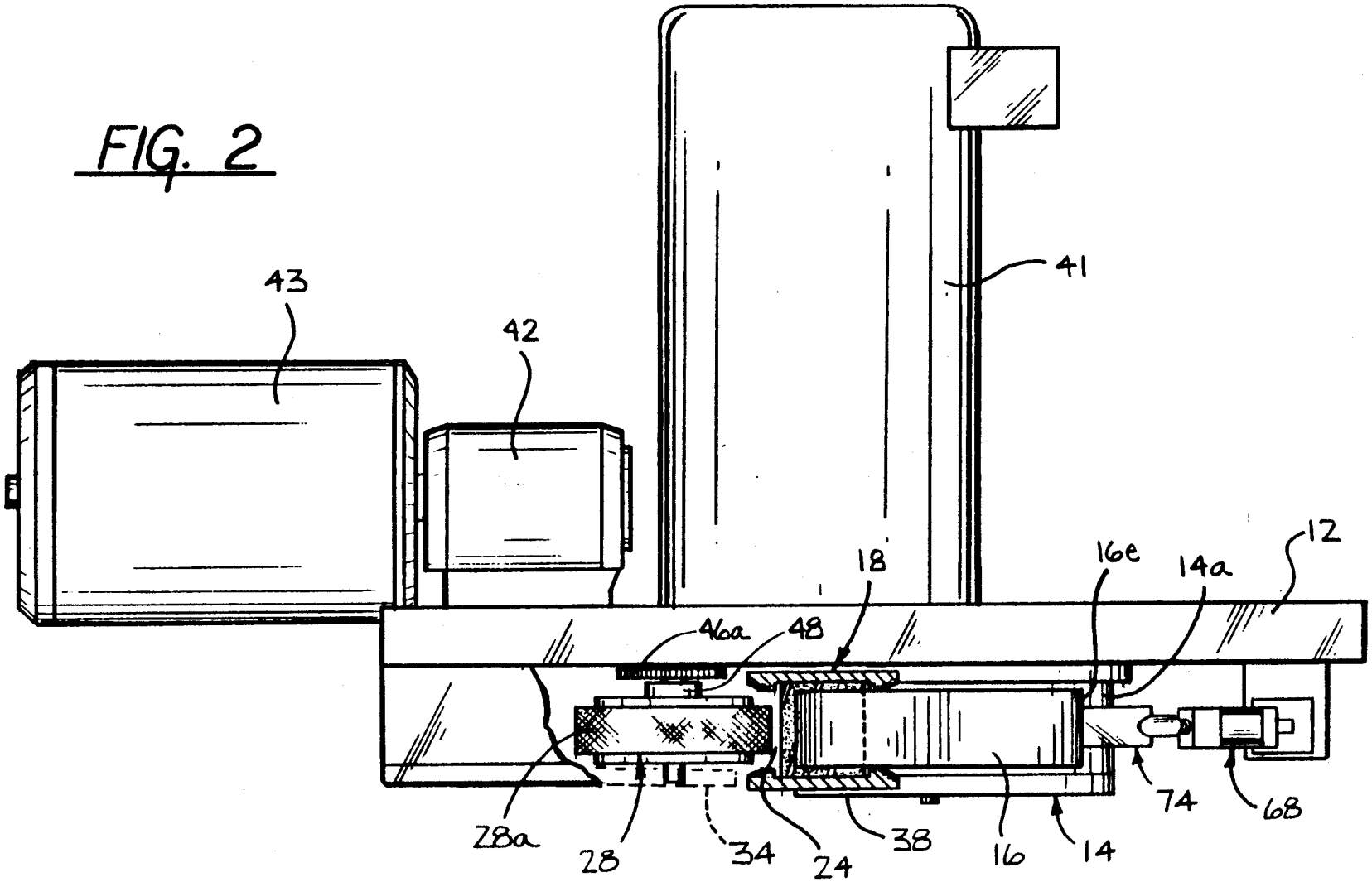
FIG. 2 is a top elevational view of the apparatus of FIG. 1 with guards removed and with a grinding wheel partially sectioned.

The drive roller 28 is mounted by a bearing block 34 on the platform 32. The bearing blocks 30, 34 respectively support the drive rollers 26, 28 for rotation on spaced axes of rotation located on one side of the finishing throat 24. The opposite side of the finishing throat 24 is defined by the outer surface 36 of the grinding wheel 18 which extends through a side opening 38 in the guide member 14. The grinding wheel 18 is held in the aforesaid position by a spindle 40 which supports the grinding wheel for rotation on an axis which is offset laterally of the axes defined by the bearing blocks 30, 34 in a horizontal plane intermediate the horizontal planes including the axes of rotation of the drive rollers 26 and 28. The spindle 40 is connected to a grinder motor 41 as shown in FIG. 2.

The drive rollers 26, 28 are connected to a gear box 42 (FIG. 2) having its input connected to the output shaft of a drive motor 43 and having its output connected to the input of a gear train 44. The gear train 44 has a first output gear 46 connected to a shaft 48 on the drive roller 26 which is driven clockwise as viewed in FIG. 1 to capture the inlet end **16*b* of an arcuate brake lining blank 16 as it first enters the finishing throat 24. The gear train 44 includes a second output gear 46*a* (FIG. 2) which rotates in the same direction as output gear 46 and is connected to the input shaft 48 of drive roller 28 to rotate it in a clockwise direction as viewed in FIG. 1. The drive roller 28 is thereby operative to capture the inlet end 16*b* as it leaves the finishing throat 24 to drive a finished arcuate brake lining 50 onto the discharge track surface 14*b* which has the same radius R to which the blanks are to be ground. As a consequence the finished blanks 50 will be smoothly discharged from the finishing throat 24 and will be disposed to freely fall by gravity from the guide member 14** for collection in a suitable collection repository.

Figure 3:
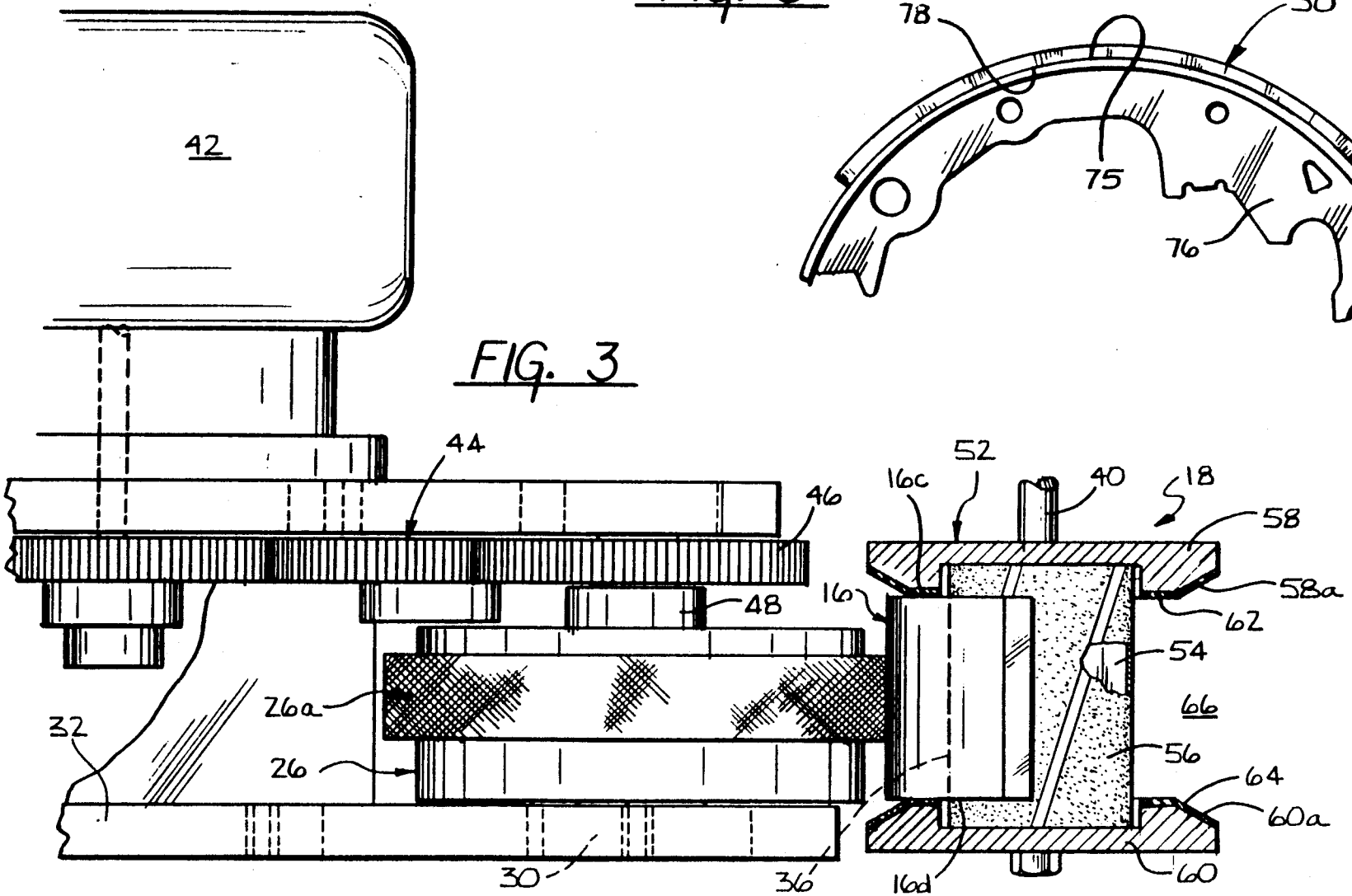
FIG. 3 is an enlarged top elevational view of a brake lining blank in a finishing throat of the present invention and with a drive roller shown in elevation and a grinder wheel shown partially sectioned.

In accordance with one aspect of the present invention, each of the drive rollers 26, 28 carries a resilient belt **26*a*, 28*a* formed circumferentially thereof. The resilient belts 26*a*, 28*a* can be formed from rubber. They each have a width which is less than the width of the brake lining blanks 16 so that they will not interfere with the grinding action of the grinding wheel 18 on side surfaces 16*c*, 16*d* of the lining blank 16** as best seen in FIG. 3.

The grinding wheel 18 includes a blank 52 with a center cylinder 54 covered with an annular abrasion wheel 56. Side plates 58, 60 of the blank 52 are covered with layers 62, 64 of abrasive material. Each of the side plates 58, 60 have a tapered segment **58*a*, 60*a* respectively which define a guide for directing the unfinished lining 16 into a wheel recess 66 through which the lining 16 is feed to simultaneously finish the sides 16*c* and 16*d* thereon as the arcuate inner surface 16*a* is being finished to the predetermined finished radius R by the abrasion wheel 56. The abrasion wheel 56 has its axis of rotation set with respect to the radius of the drive roller belts 26*a* and 28*a* to assure repeatable and highly precise formation of a desired finish radius on the inner arcuate surface of each of the finished brake linings 50**.

Figure 4:
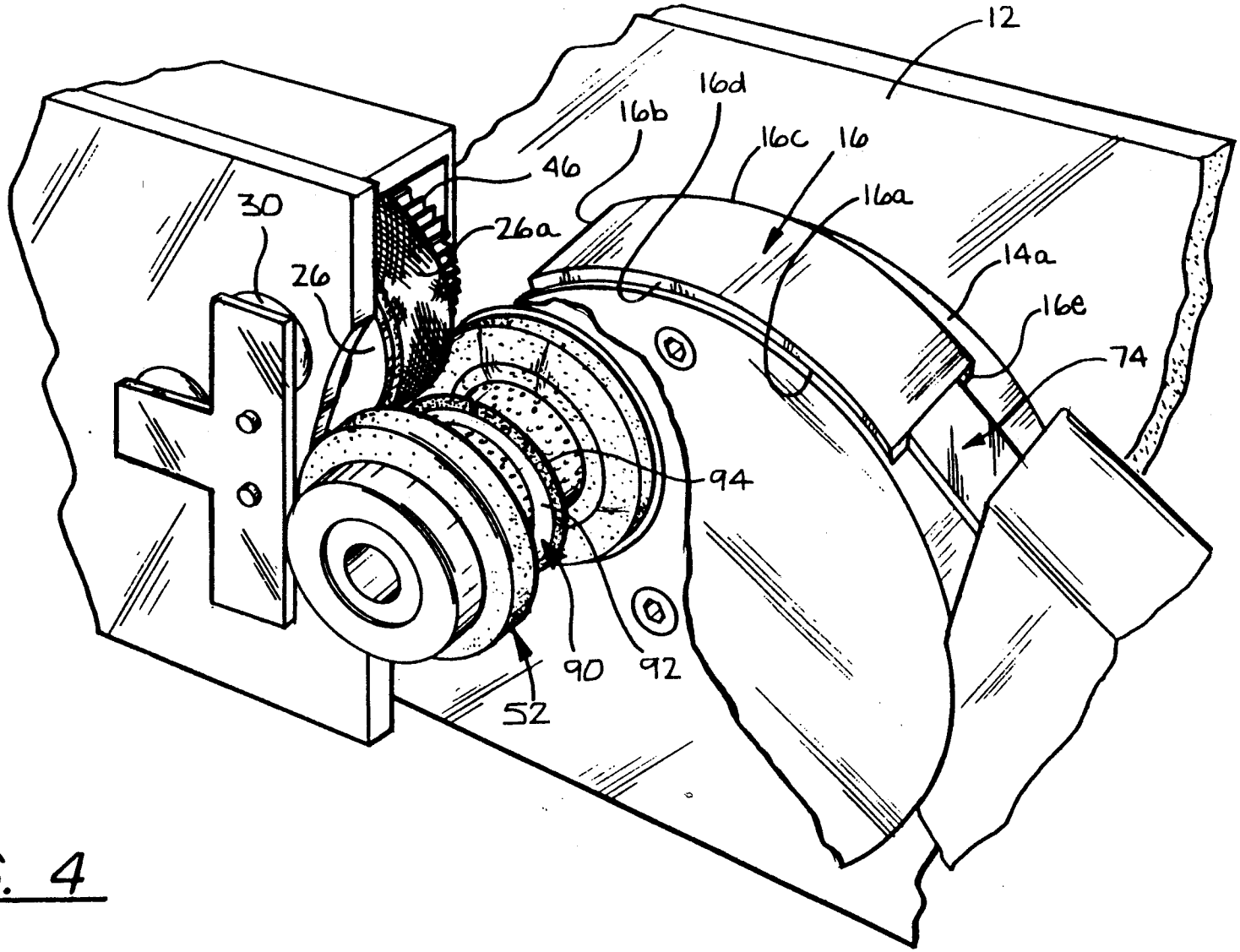
FIG. 4 is a perspective view, partially broken away of a finishing throat of the present invention including another embodiment of grinding wheel therein.

The unfinished brake linings 16 are stacked in the feed hopper and are sequentially fed therefrom by a feeder cylinder 68 which can be actuated by air pressure across its piston in a known manner. The feeder cylinder is supported on the front of the machine base 12 at a support pedestal 69. The base cap 70 of the feeder cylinder 68 is connected to the pedestal 69 and the piston rod 72 of the feeder cylinder 68 is connected to a pusher element 74. The pusher element 74 is curved so as to initially be spaced from the infeed track surface 14*a* but as the piston rod 72 extends from the cylinder 66 will be located closely adjacent the infeed track surface 14*a*. The curvature of the pusher element 74 will allow it to engage the aft end 16*e* of each of the unfinished brake linings 16 as shown in FIGS. 1 and 4 and continue to push it along the track surface 14*a* until the inlet end 16*b* is captured by the inlet drive roller 26 for feed through the finishing throat 24 which includes the aforesaid simultaneous finishing of three surfaces 16*a*, 16*c* and 16*d* on the lining 16 within the wheel recess 66.

Figure 5:
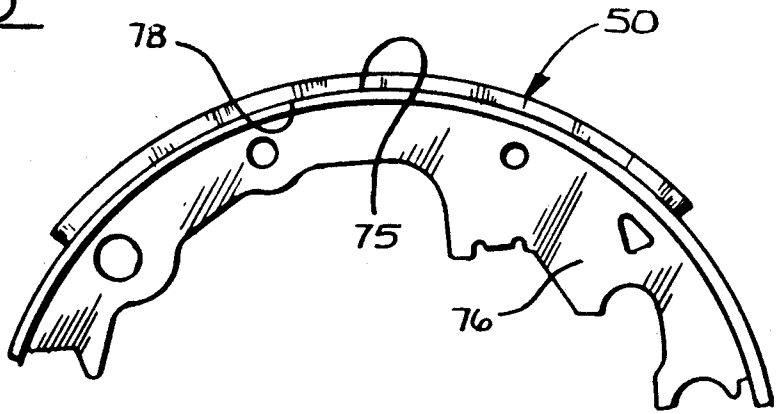
FIG. 5 is a side elevational view of a finished brake lining formed by the method of the present invention shown connected to a brake shoe.

The method of the present invention provides for grinding brake linings having a arcuate inner surface to be finished so as to be conformable to the outer arcuate surface 75 of a brake drum 76 as shown in FIG. 5. The brake drum has surface 75 precisely configured at a radius which conforms to the radius R on the finished surface 78 of the finished brake lining 50. The process includes the steps of providing a brake lining blank 16 of arcuate shape and having an arcuate unfinished pair of side walls 16*c* and 16*d* and an arcuate unfinished inner surface 16*a* thereon; and providing a guide member 14 having diametrically opposite curved guide surfaces 14*a* and 14*b* thereon. The process includes forming one of the surfaces at a radius X which is larger than the maximum fee state radius of the unfinished brake lining and the other of the guide surfaces at a radius R equal to the radius of the inner arcuate surface of a finished brake lining 50.

The process further includes providing a grinder 18 between the guide surfaces 14*a* and 14*b* with the grinder 18 including a generally arcuate finishing recess 66 formed in part by a rotatable cylindrical abrasive wheel 56 for removing material from the inner surface of a brake lining blank.

The process alternatively includes the step of stacking a plurality of unfinished brake lining blanks on the guide surface as shown in FIG. 1 and then forcing individual ones of the stacked brake lining blanks from the guide surface into the grinder recess for feed through the finishing throat. Thereafter a selected thickness of material is removed from the inner arcuate surface of the brake lining in accordance with the grinding radius of the annular abrasion wheel to produce a finished lining having a precise arcuate shape conforming to the exterior arcuate surface of a brake shoe irrespective of differences in the shape of the inner arcuate surfaces of the brake lining blanks stacked on the inlet guide surface.

In another aspect, the method of the present invention includes the steps of running the unfinished brake lining 16 across a guide surface of a radius greater than that of the inner arcuate surface 16*a* thereon during the infeed to the grinder and removing the finished brake lining 16 by directing it across a discharge guide surface on track 14*b* which has a radius equal to the radius of the finished brake lining at the arcuate inner surface thereof.

In still another aspect, the method includes the steps of simultaneous cutting and finishing of each of the stacked brake lining blanks for forming a plurality of finished linings from a single one of the stacked brake lining blanks as it is fed through the grinder recess 66.

The apparatus for performing the last step of simultaneous grinding and cutting is shown in FIG. 4 wherein like parts in the embodiment of apparatus in FIGS. 1–3 are designated with the same reference numerals. This embodiment, in addition to the previously described parts, has a slitter knife 90 with its base connected to a rib 92 on the cylindrical core of the grinding wheel blank 52. The slitter knife 90 has its cutting edge located below the outer surface of the resilient belt 26*a* such that feed of an unfinished brake lining blank 16 into driving engagement with the drive roller 26 will force the inside arcuate surface 16*a* thereon against a sharp circumferential edge 94 of the slitter knife 90. Progressive feed of the brake lining blank 16 through the finishing throat 24 will cause the slitter knife 90 to penetrate and eventually pierce the full thickness of the blank so as to form two pieces as the sides 16*c* and 16*d* and inner surface 16*a* of the blank are finished by the grinder wheel. The two pieces are then captured by the discharge drive roller 28 and are directed onto the discharge track surface 14*b* for gravity discharge from the grinder apparatus 10.

It should be understood that a suitable controller (not shown) is provided with safety switches, limit switches and start and stop switches, all of a known kind, to control energization of the motors 41, 43 and feeder cylinder 68 for automatic, sequential feed of one or one of a plurality of brake lining blanks from the feed hopper 20 for finishing by the aforedescribed apparatus.

From the foregoing it can be seen that the apparatus and method of the present invention are able to sequentially process a large number of blanks in a continuous fashion along multiple surfaces. The apparatus and method has application to a wide range of brake lining material types and brake lining shapes. The process will result in a finished product which is readily assembled to brake shoes with assured conformity therebetween as desired in present day statistical process methodology.

Various modifications and changes may be made without departing from the scope of the invention as set forth in the appended claims.

What is claimed is:

1. Apparatus for finish grinding an inside diameter of an arcuate interior surface of a lining for connection to the arcuate outer surface of a brake shoe in close conformity therewith comprising:

a support member;

grinding wheel means;

infeed and discharge track means on said support member providing a guide for directing a lining into and out of said grinding wheel means, said infeed track having a first radius conforming to the radius of an unfinished brake shoe and said discharge track having a radius conforming to a finished brake shoe;

first and second rotatable feed wheel means spaced from one another and disposed on rotational axes located at predetermined operative distances from each other and from said infeed and discharge track means respectively and operative to grip and drive the lining with respect to said infeed and discharge track means and said grinding wheel means;

said grinding wheel means including an abrasive wheel and means for mounting said abrasive wheel for rotation on an axis laterally offset from and between the axes of said feed wheel means;

said abrasive wheel having an outer circular grinding surface spaced from said wheel means for defining a finishing throat which accommodates the thickness of the lining and which will locate the interior surface of the lining in operative engagement with said abrasive wheel to remove material from the lining to cause the interior surface of the lining to correspond to the exterior arcuate surface of a brake shoe for enhancing mounting of the lining to the brake shoe at an interface therebetween.

2. The apparatus of claim 1, wherein said abrasive wheel has a cylindrical center segment forming the outer circular grinding surface and a pair of spaced side segments defining an arcuate recess to receive the lining and wherein said side segments finish the opposite sides of the lining while the arcuate interior surface is being finished by said cylindrical center segment.

3. The apparatus of claim 1, including feed hopper means for feeding unfinished brake linings onto said infeed track means; and selectively operable actuator means for contacting said lining and pushing said lining from said infeed track means into said finishing throat.

4. Apparatus for finish grinding the inside diameter of an arcuate interior surface and side surfaces of a lining blank for a brake shoe of automotive brakes comprising:

a guide member;

infeed and discharge track means on said guide member providing a guide for the lining blank;

first and second rotatable feed wheel means mounted on rotational axes and spaced a predetermined operative distance from one another and from said infeed and discharge track means for driving said lining blank in a finishing path;

grinding wheel means located adjacent said finishing path for removing material from the lining blank to conform the arcuate interior surface to the outer arcuate surface of a brake drum;

said grinding wheel means supported on a rotational axis laterally spaced a predetermined distance from said feed wheel means for defining a finishing throat having an arcuate path for causing the arcuate interior surface of the lining blank to be ground to a predetermined finished radius;

said grinding wheel means having opposed side surfaces for finishing the side surfaces of the lining blank as the lining blank passes through the finishing throat.

5. The apparatus of claim 4, wherein said grinding wheel means is an abrasive wheel having a cylindrical center segment forming the outer circular grinding surface and wherein the side surfaces of said grinding wheel means are a pair of spaced abrasive side segments defining an arcuate recess to receive the lining blank and wherein said abrasive side segments finish the opposite sides of the lining blank while the arcuate interior surface is being finished by said cylindrical center segment.

6. The apparatus of claim 4, including feed hopper means for feeding unfinished brake linings onto said infeed track means; and selectively operable actuator means for contacting a lining blank and pushing the lining blank from said infeed track means into said finishing throat.

7. The apparatus of claim 1, wherein said grinding wheel means includes means for cutting said lining into parts to form a plurality of finished linings as the brake lining is directed through said finishing throat.

8. The apparatus of claim 4, wherein said grinding wheel means includes means for cutting said lining blank into parts to form a plurality of finished linings a the brake lining is directed through said finishing throat.

9. The apparatus of claim 7, wherein said cutter means includes an annular knife edge at the center of said abrasive wheel engageable with a lining as it is fed through said finishing throat for cutting through the thickness of said lining as the arcuate inner surface thereon is finish ground by said grinding wheel means.

10. The apparatus of claim 8, wherein said cutter means includes a annular knife edge at the center of said abrasive wheel engageable with said lining as it is fed through said finishing throat for cutting through the thickness of said lining as said arcuate inner surface is finish ground by said grinding wheel means.

11. A method for grinding brake linings having an arcuate inner surface to be finished so as to be conformable to the outer arcuate surface of a brake drum comprising the steps of;

providing a brake lining blank of arcuate shape and having an arcuate unfinished pair of side walls and an arcuate unfinished inner surface thereon;

providing an inlet guide surface having a curved guide surface thereon of a radius conforming to a maximum actual free state radius of the unfinished arcuate inner surface of said brake lining;

providing a centerless grinder between said guide surfaces including a generally arcuate finishing throat formed in part by a rotatable cylindrical abrasive surface for removing material from the inner surface of a brake lining blank;

supporting a plurality of stacked brake lining blanks on the inlet guide surface;

forcing individual ones of the stacked brake lining blanks from the inlet guide surface into the centerless grinder for feed through the finishing throat;

providing a discharge guide surface diametrically opposite said inlet guide surface of a radius conforming to the finished radius of the arcuate inner surface of said brake lining;

supporting an individual one of the brake linings blanks fed through the finishing throat on the discharge guide surface;

removing a selected thickness of material from the inner arcuate surface of the brake lining in accordance with the grinding radius of the centerless grinder to produce a finished lining having a precise arcuate shape conforming to the exterior arcuate surface of a brake shoe irrespective of differences in the shape of the inner arcuate surfaces of the brake lining blanks stacked on the inlet guide surface.

12. The method of claim 11, wherein the steps include simultaneous cutting and finishing of each of the stacked brake lining blanks for forming a plurality of finished linings from a single one of the stacked brake lining blanks fed through said finishing throat.

13. Apparatus for finish grinding the side surfaces and the inside diameter of an arcuate interior surface of a lining for connection to the arcuate outer surface of a brake shoe in close conformity therewith comprising:

a support member, grinding wheel means;

infeed and discharge track means on said support member providing a guide for directing a lining into and out of said grinding wheel means;

first and second rotatable feed wheel means spaced from one another and disposed on rotational axes located at predetermined operative distances from each other and from said infeed and discharge track means respectively and operative to grip and drive the lining with respect to said infeed and discharge track means and said grinding wheel means;

said grinding wheel means including an abrasive wheel and means for mounting said abrasive wheel for rotation on an axis laterally offset from and between the axes of said feed wheel means;

said abrasive wheel having an outer circular grinding surface spaced from said wheel means for defining a finishing throat which accommodates the thickness of the lining and which will locate the interior surface of the lining in operative engagement with said abrasive wheel to remove material from the lining to cause the interior surface of the lining to correspond to the exterior arcuate surface of a brake shoe for enhancing mounting of the lining of the brake shoe at an interface therebetween and wherein said abrasive wheel has a cylindrical center segment forming the outer circular grinding surface and a pair of spaced side segments defining an arcuate recess to receive the lining and wherein said side segments finish the opposite sides of the lining while the arcuate interior surface is being finished by said cylindrical center segment.

* * * * *